United States Patent [19]

Domhan et al.

[11] 4,408,111

[45] Oct. 4, 1983

[54] INTERNAL LOCKING ARRANGEMENT FOR A SWITCH MACHINE

[75] Inventors: Gerold Domhan, Stuttgart; Franz Hartl, Keltern-Dietenhausen; Kurt Vogelgsang, Rutesheim, all of Fed. Rep. of Germany

[73] Assignee: International Standard Electric Corporation, New York, N.Y.

[21] Appl. No.: 267,955

[22] Filed: May 28, 1981

[30] Foreign Application Priority Data

May 31, 1980 [DE] Fed. Rep. of Germany ..... 3020788

[51] Int. Cl.[3] ..... H01H 1/52; H01H 9/00; H01H 9/20

[52] U.S. Cl. ..... 200/318; 200/320; 200/323; 335/167; 335/169

[58] Field of Search ..... 200/318-320, 200/323, 225, 327, 153 V, 18, 241; 74/527; 335/167, 169

[56] References Cited

U.S. PATENT DOCUMENTS

| | | | |
|---|---|---|---|
| 3,134,879 | 5/1964 | Gauthier | 200/325 |
| 3,267,234 | 8/1966 | Stewart et al. | 335/167 |
| 3,492,451 | 1/1970 | Ponterio | 200/325 |
| 4,107,499 | 8/1978 | Weidler | 200/18 |
| 4,180,716 | 12/1979 | Suzuki | 200/320 |

FOREIGN PATENT DOCUMENTS

| | | | |
|---|---|---|---|
| 2444043 | 3/1976 | Fed. Rep. of Germany | 200/318 |

*Primary Examiner*—Stephen Marcus
*Assistant Examiner*—Ernest Cusick
*Attorney, Agent, or Firm*—John T. O'Halloran; Peter R. Ruzek

[57] ABSTRACT

A switch machine which is connected by two throw rods to the respective switch points to be operated includes an internal locking arrangement which includes two holding elements pivotally mounted on the respective throw rods and accommodated between a sliding member and a displacement member of the switch machine which are disengageably connected to one another. Each of the holding elements has a free end which is enlarged by two tongues respectively extending toward the sliding member and the casing of the switch machine. Depending on the position of the sliding member, the tongues are received in the associated recesses in the sliding member or in the casing to thereby either lock the throw rods in their positions relative to the casing or to entrain the same for movement with the sliding member. During trailing of the switch points, the connection between the displacement member and the sliding member is discontinued so that the sliding member can move with the holding elements and the throw rods relative to the displacement member which is arrested in its position. This connection is re-established during the subsequent throwing of the switch.

6 Claims, 8 Drawing Figures

INTERNAL LOCKING ARRANGEMENT FOR A SWITCH MACHINE

BACKGROUND OF THE INVENTION

The present invention relates to an internal locking arrangement for a switch machine.

There is already known an internal locking arrangement for a switch machine wherein the throwing forces act on the switch points via a sliding piece disposed in the mechanism casing and movable in the direction of movement of the switch points, and via two rods, and wherein the driving force is transmitted from the drive unit to the sliding piece via a spring box lockable in its limit positions and containing a spring-loaded roller or ball which releasably engages in a corresponding depression in the sliding piece.

An internal locking arrangement of this type forms part of a switch machine with internal locking as disclosed in published German application DE-OS No. 26 06 664.

In that switch machine, locking is effected via so-called detector bars (locking bars), which are actually designed to detect the limit positions of the switch and actuate contacts in response thereto. Detector bars which are to be used as locking elements must be much more rugged in construction and, hence, larger in dimensions than would be necessary to perform a pure detecting function. Trailable and non-trailable designs of switch machines lockable via detector bars differ in various respects and include different parts and, except in the embodiment described in claim 4 of the above-identified German application, subsequent conversion of the switch machine (e.g. from trailable to non-trailable) necessitates replacing many parts of the machine.

SUMMARY OF THE INVENTION

Accordingly, it is a general object of the present invention to overcome the disadvantages of the prior art.

More particularly, it is an object of the invention to provide a locking arrangement for a switch machine, which is simple in construction, easy to convert from trailable to non-trailable, and reliable in operation, nevertheless.

Another object is to develop an internal locking arrangement for a trailable or non-trailable switch machine in which the detector bars are used only to monitor the limit positions of the points.

In pursuance of these objects and others which will become apparent hereafter, one feature of the present invention resides in an internal locking arrangement used in a switch machine connected by two throw rods to the respective switch points to be operated and including a driving unit, a casing, a sliding member in the casing operatively connected to the throw rods for movement therewith in the directions of movement of the switch points, a displacement member displaceable by the driving unit in the casing in the aforementioned directions between two limiting positions and means for releasably connecting the sliding and displacement members with one another for joint movement, including a depression in one of the members and a spring-loaded connecting element mounted on the other member and engagable in the depression, the internal locking arrangement being arranged in the casing and comprising means for releasably arresting the displacement member in said limiting positions thereof; and means for transmitting forces between the sliding member, the casing and the throw rods and for holding the latter in respective end positions thereof relative to the casing, including means for delimiting a gap between the sliding member and the casing, including mutually facing delimiting surfaces on the sliding member and on the casing, these surfaces bounding the aforementioned gap and being spaced by a predetermined distance from one another, at least two holding elements situated in the gap and each pivotally mounted on one of the throw rods and having at least two projections each extending toward one of the delimiting surfaces to such an extent that the dimension of the respective holding element measured across the projections exceeds said predetermined distance; and means for defining in the sliding member and in the casing respective recesses which open onto the respective delimiting surfaces and are arranged to receive the respective projections of the respective holding elements therein.

The use of two holding elements as are employed in similar form in clamp point locks (see, for example, published German application DE-OS No. 23 45 184, FIG. 1) makes it possible to safely lock the closed point against the mechanism casing and to secure the open point in its limiting position. A switch equipped with the internal locking arrangement according to the invention can be trailed only via the open point and only if an adjustable force required to hold the spring-loaded connecting element or roller in the depression in the sliding member is exceeded. This also applies to the first phase of the trailing process, during which no force is exerted on the roller of the switch machine described in German application No. 26 06 664 because there the play between the sliding member and the throw rods due to the oblong configuration of the holes in the sliding member must be overcome first.

A particularly advantageous embodiment of the locking clamps which has proved successful in clamp point locks is obtained when each of the holding elements is elongated and has a free end remote from the axis of pivoting thereof on the respective throw rod, the projections being arranged at the free end opposite to one another to form an enlarged portion on the free end, the projections having substantially parallel side surfaces which are inclined relative to the longitudinal direction of the respective holding element to give the enlarged portion a dovetail-like configuration, and when the recesses are bounded by respective side surfaces having substantially the same inclination as the side surfaces of the respective projections.

The design of the sliding member is expecially advantageous when it has a central portion having the respective delimiting surface, and two end portions each situated to the other side of the respective recess in the sliding member from the central portion, and when the end portions extend beyond the plane of the delimiting surface of the sliding members toward the casing to form nose-like projections at that side of the sliding member which faces the delimiting surface of the casing.

The releasably arresting means is particularly simple when it includes at least two parts mounted on one and engagable with the other of the displacement member and casing. The internal locking arrangement advantageously further comprises means for displacing the parts between their arresting and releasing positions. The internal locking arrangement may be equipped with means for releasing the arresting means which may be constructed as a pivotally mounted rocker lever having two pawl-shaped end portions engaging the arresting means, and means for pivoting the lever in the direction required for releasing the arresting means.

BRIEF DESCRIPTION OF THE DRAWING

Above-mentioned and other features and objects of this invention will become more apparent by reference to the following description taken in conjunction with accompanying drawing, in which.

DETAILED DESCRIPTION OF THE THE PREFERRED EMBODIMENTS

Figure 1A:
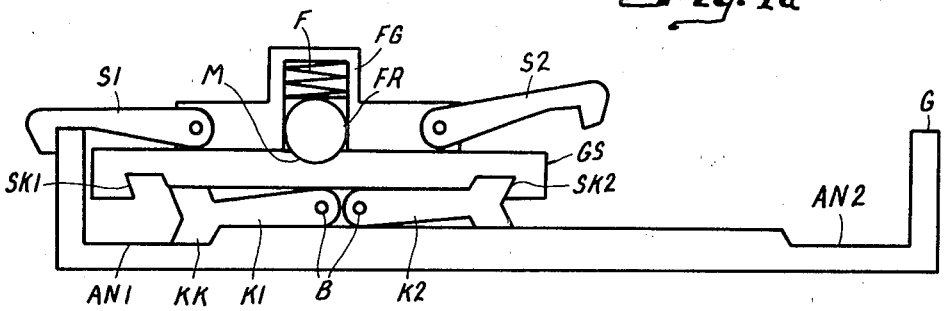
FIGS. 1*a* to 1*c* are sectional views of the internal locking arrangement according to the invention in different non-trailed positions of the switch.
Figure 1B:
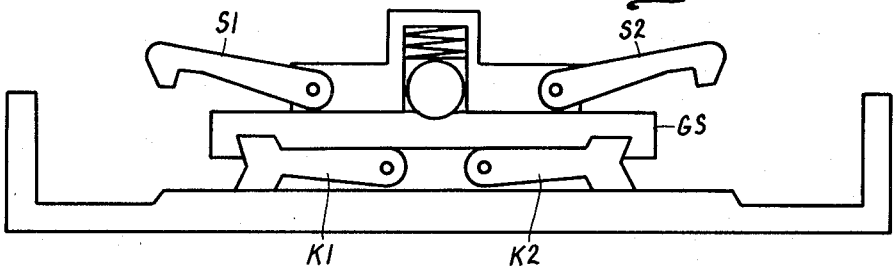
Figure 1C:
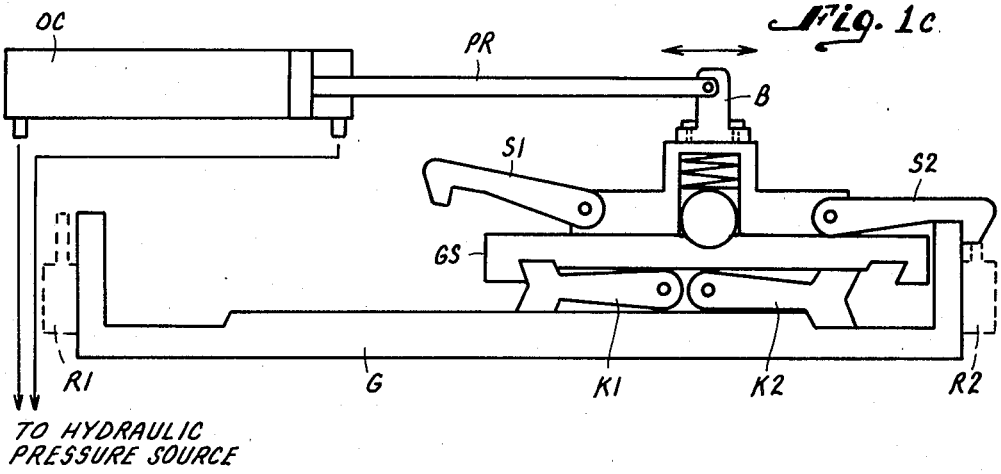

FIG. 1*a* is a schematic sectional view of an internal locking arrangement according to the invention in the left-hand position of the switch. The section is taken in the middle of the internal locking arrangement, parallel to the direction of movement of the points. The drawing shows a casing G, which will henceforth be called "mechanism case", and a displacement member or spring box FG accommodating a roller or a similar connecting element FR which is disengageably held by a spring F in a depression M in a sliding member GS located therebelow. As shown in FIG. 1*c*, the spring box FG can be moved in the directions indicated by the double-headed arrow by a main operating cylinder OC stationary with respect to the mechanism case G, via a piston rod rod PR and a mounting bracket B secured on the spring box FG. So long as received in the depression M, the connecting element FR will entrain the sliding member GS for joint movement with the spring box FG. Between the sliding piece GS and the mechanism case G, two holding elements or locking clamps K1 and K2 are located in a gap. Each of these locking clamps K1 and K2 has a dovetail-like head KK having upwardly and downwardly directed projections or tongues, and a main portion whose end opposite to the clamp head KK is provided with a hole B which serves to hinge the respective clamp K1 and K2 to one of two throw rods (ST1, ST2 in FIG. 2*a*). Pivoted to the spring box FG are two pawls S1, S2, which, as soon as the spring box FG reaches a limiting position, drop into corresponding notches or spaces on parts firmly connected with the mechanism case G, thus arresting the spring box FG in its limiting position. In FIG. 1*a*, the edge of case wall forms such a part. The spring box FG can be unlocked only by lifting the dropped-in pawl (S1 in FIG. 1) by means of a special operating cylinder which acts on the respective pawl S1, S2 or, via a rocker, on both pawls S1, S2 alternately.

Figure 3A:
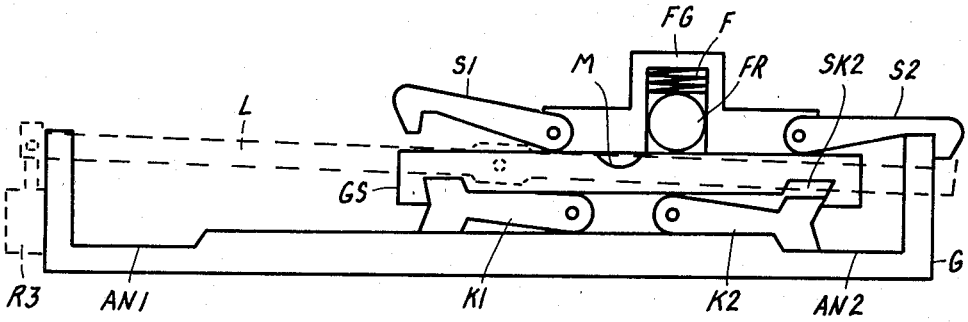
FIGS. 3*a* and 3*b* are views similar to FIGS. 1*a* to 1*c* but in the trailed position of the switch.

These possibilities are shown in dashed lines in FIGS. 1*c* and 3*a*, respectively. In FIG. 1*c*, there are shown two cylinder-and-piston units R1 and R2 which are mounted on the mechanism case G in such positions as to be able to cooperate with the pawls S1 and S2, respectively. As shown for the unit R2, in its retracted position, the respective unit R1 or R2 permits the respectively associated pawl S1 or S2 to engage the mechanism case G. In its extended position, as shown for unit R1, the respective unit R1 or R2 causes the associated pawl S1 or S2 to disengage the case G. FIG. 3*a* shows a rocker lever L which is mounted for pivoting in this construction on the case G. A double-acting cylinder and piston unit R3 is mounted on the case G and its movable part or piston rod is articulated to one end of the rocker lever L. The ends of the rocker lever L are pawl-shaped and are so situated as to engage the respective pawls S1, S2 as the unit R3 causes the lever L to pivot from one of its terminal positions to the other, and thus to disengage that one of the pawls S1, S2 which has been previously engaged with the case G. Of course, the units R1, R2 and R3 could also be constituted by electromagnets or similar electromechanical devices.

The sliding piece GS, which is disengageably connected with the spring box FG via the roller FR until a holding force adjustable via the pretension of the spring F is exceeded, has at its bottom side two oblique recesses SK1, SK2, which render it possible to establish a positive connection with the upwardly directed tongues of the heads KK of the two locking clamps K1, K2. In addition, the portions of the sliding piece GS which extend between the ends of the sliding piece GS and the oblique recesses SK1, SK2 are thicker than the center portion, thus forming nose-like projections at the bottom side of the sliding piece GS. The mechanism case G also has recesses AN1, AN2 for receiving the downwardly directed tongues of the heads KK of the locking clamps K1, K2. These recesses AN1, AN2 may also be oblique recesses. However, since, in this embodiment, forces are applied only to those slopes of the recesses AN1, AN2 which are directed toward the center of the mechanism case G, as will be shown in the following, the recesses AN1, AN2 in the mechanism case G may also extend all the way up to the case wall, as shown in FIGS. 1*a* to 1*c*, 3*a* and 3*b*. It is also possible to make the recesses AN1, AN2, rather than in the mechanism case itself, in a sliding plate rigidly connected with the case G.

Figure 2A:
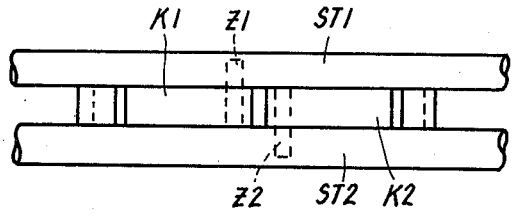
FIGS. 2*a* and 2*b* are, respectively, top and side views of holding elements and throw rods employed in the arrangement of the present invention.
Figure 2B:
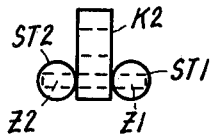

FIG. 2*a* shows in a top view how the locking clamps K1, K2 of the internal locking arrangement according to the invention are mounted on the associated throw rods ST1 and ST2. Both locking clamps K1, K2 are arranged between the throw rods ST1, ST2 pivotally supported on pins Z1, Z2 fitted into the throw rods ST1, ST2. The locking clamp K1 is connected with the throw rod ST1 via the pin Z1, and the locking clamp K2 is connected with the throw rod ST2 via the pin Z2.

Figure 4:
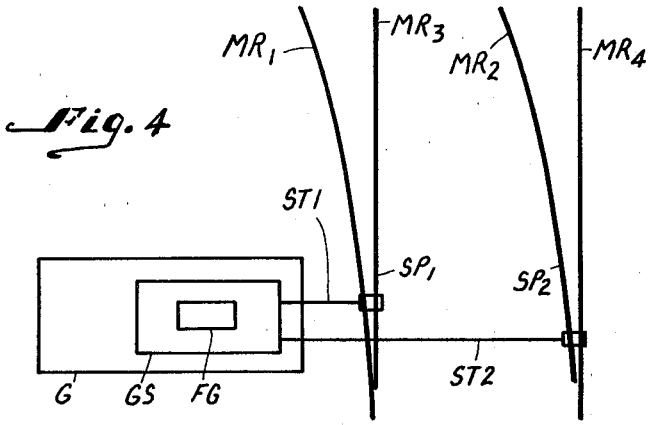
FIG. 4 is a diagrammatic top plan view of a rail switch illustrating an example of the location of switch machine incorporating the internal locking arrangement of FIGS. 1*a* to 3*b* relative to the switch points and the associated rail sections.

As shown in a highly simplified manner in FIG. 4, the throw rods ST1 and ST2 are respectively connected to switch points SP1 and SP2 located at the region of gradual merger of two rail tracks one of which includes main rails MR1 and MR2, while the other includes main rails MR3 and MR4. The way in which the switch points SP1 and SP2 are connected to the main rails MR3 and MR2, respectively, and the way in which the throw rods ST1 and ST2 are connected to the switch points SP1 and SP2, respectively, are conventional and hence have not been shown in detail. Suffice it to say that movement of the throw rods ST1 and ST2 in the leftward direction from the position of FIG. 4 will bring the switch point SP1 to the main rail MR1 and the switch point SP2 away from the main rail MR4.

The operation of the internal locking device according to the invention will now be described with respect to two sequences of operations, "throwing" in connection with FIGS. 1*a* to 1*c*, and "trailing" in connection with FIGS. 3*a* and 3*b*.

FIG. 1*a* shows the internal locking arrangement in its left-hand limiting position. The spring box FG is locked against the mechanism case G via its left-hand pawl S1. The sliding piece GS is connected with the spring box FG via the roller FR, so that it is in its left-hand end position as well. The locking clamp K1 is connected with the then closed point SP1 (not shown) via the throw rod ST1 (not visible). The head KK of this locking clamp K1 has dropped into the recess AN1 in the mechanism case G and is locked by the central portion of the sliding piece GS, i.e., the clamp head KK cannot be moved out of the recess AN1 in the mechanism case G as long as the sliding piece GS is not moved to the right to such an extent that the oblique recess SK1 provided in the sliding piece GS on the left side of the clamp head KK lies above this head KK and permits the latter to pivot upwardly.

In the limit position shown in FIG. 1*a*, the then closed point SP1 is thus locked, and the then open point SP2 (not shown) is secured in position and, unless the spring box FG has been previously unlocked, can be displaced from its position only if the force acting on the point SP2 is large enough to move the roller FR out of the depression M in the sliding piece GS.

When the switch is to be thrown over, the left-hand pawl S1 is lifted. In an electrohydraulic switch machine, this is done, for example, by a hydraulic cylinder (shown at R1) to which pressure is admitted simultaneously with the admission of pressure to the main operating cylinder OC which generates the point-operating force and acts on the spring box FG. After the left-hand pawl S1 has been disengaged, the spring box FG moves to the right under the action of the force of the main operating cylinder OC. The sliding piece GS and the right-hand locking clamp K2 together with the spring box FG move since the head KK of the locking clamp K2 has engaged the right-hand recess SK2 of the sliding piece GS via its upwardly directed tongue. The right-hand locking clamp K2 slides on the bottom or delimiting surface of the mechanism case G and moves the previously open point SP2 to the right via the throw rod ST2, which is connected with it. After the sliding piece GS has moved a short distance to the right, the head KK of the left-hand locking clamp K1 engages in the left-hand oblique recess SK1 of the sliding piece GS. This head KK is lifted to such an extent that the downwardly directed tongue of this head KK moves out of engagement with the recess AN1 in the mechanism case G, so that the then closed point SP1 is unlocked. The left-hand locking clamp K1 is now taken along by the sliding piece GS into the position shown in FIG. 1*b*, thus moving the previously closed point SP1 to the right via the throw rod ST1. Upon reaching the right-hand recess AN2 in the mechanism case G, the head KK of the right-hand locking clamp K2 disengages from the oblique recess SK2 in the sliding piece GS and drops into the recess AN2 in the bottom or limiting surface of the mechanism case G. The hitherto open point SP2 has thus reached its closed position. The spring box FG, together with the sliding piece GS, is moved further to the right until the right-hand pawl S2 locks the spring box (FIG. 1*c*) and until the switch machine is turned off via the respective detector bars (not shown) and detector contacts operated by the detector bars. During the last phase of the movement, the sliding piece GS has moved over the right-hand locking clamp K2 further to the right, and its central portion now locks the right-hand locking clamp K2 and, hence, the point SP2 which is now in the closed position (FIG. 1*c*). The throwing movement from right to left is analogous.

Figure 3B:
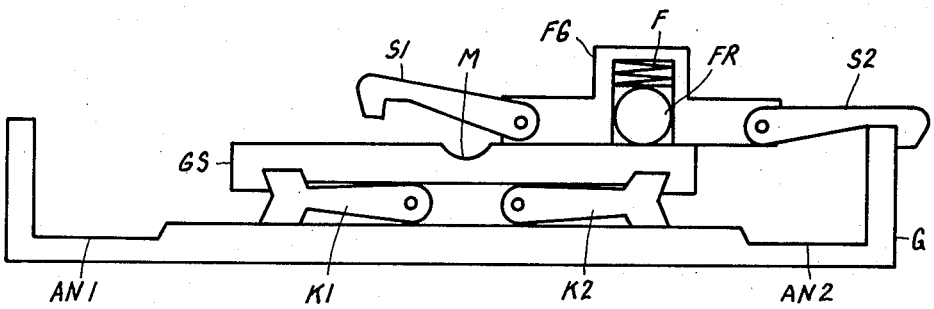

If the switch, which is now in its right-hand position corresponding to FIG. 4, is trailed through as shown in FIGS. 3*a* and 3*b*, the open point SP1 is first urged to the left with a considerable trailing force. The trailing force acts via the associated throw rod ST1 on the left-hand locking clamp K1 and, since the latter is engaged with the sliding piece GS, on the sliding piece GS as well. Inasmuch as the sliding piece GS is disengageably connected with the locked spring box FG via the roller FR up to the point when the adjustable holding force of the roller FR is overcome, andsince the locking of the spring box FG is not released, the holding force is quickly overcome so that the roller FR is moved out of the depression M in the sliding piece GS. The sliding piece GS can now slide to the left relative to the spring box FG and, like in the throwing process, takes along the right-hand locking clamp K2 together with the associated closed point SP2.

Via contacts (not shown), the above-discussed trailing of the switch causes a trailing indication at the interlocking station, in response to which the switch is thrown over to its left-hand limit position. To accomplish this, the spring box FG is unlocked and moved to the left in the same manner as described above. During this movement, the roller FR rolls on the sliding piece GS until it engages the depression M and re-establishes the disengageable connection lost as a result of the trailing process. At the end of the throwing process, the locking device is again in the position shown in FIG. 1*a*.

If the internal locking arrangement according to the invention is to be used in conjunction with a non-trailable switch, the trailable feature can be removed, for example, in the manner described in connection with claim 4 of DE-OS No. 26 06 664, i.e., by blocking the roller FR. It is at least just as simple to make a permanent joint between the sliding piece GS and the spring box FG by means of screws which are inserted into prepared holes, if required to achieve non-trailablity.

While we have described above the principles of our invention in connection with specific apparatus it is to be clearly understood that this description is made only by way of example and not as a limitation to the scope of our invention as set forth in the accompanying claims.

We claim:

1. In a switch machine connected by two throw rods to the respective switch points to be operated and including a driving unit, a casing, a sliding member in the casing operatively connected to the throw rods for movement therewith in the directions of movement of the switch points, a displacement member displaceable by the driving unit in the casing in the aforementioned directions between two limiting positions, and means for releasably connecting the sliding and displacement members with one another for joint movement, including a depression in one of the members and a spring-loaded connecting element mounted on the other member and engageable in the depression, an internal locking arrangement in the casing comprising:

means for releasably arresting the displacement member in said limiting positions thereof;

means for transmitting forces between the sliding member, the casing and the throw rods and for holding the latter in respective end positions thereof relative to the casing including means for delimiting a gap between the sliding member and the casing, including mutually facing delimiting surfaces on the sliding member and on the casing bounding said gap and spaced by a predetermined distance from one another, at least two holding elements situated in said gap and each pivotally mounted on one of the throw rods and having at least two projections each extending toward one of said delimiting surfaces to such an extent that the dimension of the respective holding element measured across said projections exceeds said predetermined distance, and means for defining in the sliding member and in the casing respective recesses which open onto the respective limiting surfaces and are arranged to receive the respective projections of the respective holding elements therein.

2. The internal locking arrangement as defined in claim 1, wherein each of said holding elements is elongated and has a free end remote from the axis of pivoting thereof on the respective throw rod, said projections being arranged at said free end opposite to one another: to form an enlarged portion on said free end; wherein said projections have substantially parallel side surfaces which are inclined relative to the longitudinal direction of the respective holding element to give said enlarged portion a dovetail-like configuration; and wherein said recesses are bounded by respective side surfaces having substantially the same inclination as said side surfaces of the respective projections.

3. The internal locking arrangement as defined in claim 1, wherein the sliding member has a central portion having said delimiting surface, and two end portions each situated to the other side of the respective recess in the sliding member from the central portion; and wherein said end portions extend beyond the plane of said delimiting surface of the sliding member toward the casing to form nose-like projections at that side of the sliding member which faces said delimiting surface of the casing.

4. The internal locking arrangement as defined in claim 1, wherein said releasably arresting means includes at least two pawls mounted on one and engageable with the other of said displacement member and casing.

5. The internal locking arrangement as defined in claim 4; and further comprising means for displacing said pawls between their arresting and releasing portions.

6. The internal locking arrangement as defined in claim 1; and further including means for releasing said arresting means, including a pivotally mounted rocker lever having two pawl-shaped end portions engaging said arresting means, and means for pivoting said lever in the direction required for releasing said arresting means.

* * * * *